US005456956A

United States Patent [19]

Todd

[11] Patent Number: 5,456,956

[45] Date of Patent: Oct. 10, 1995

[54] GARDEN ORNAMENT WITH WEIGHTED BASE AND STABILITY ENHANCER

[76] Inventor: Alvin E. Todd, P.O. Box 924, Pigeon Forge, Tenn. 37868-0924

[21] Appl. No.: 300,395

[22] Filed: Sep. 2, 1994

[51] Int. Cl.[6] ..... A63H 3/00; B44C 3/06

[52] U.S. Cl. ..... 428/16; 428/15; 428/542.2

[58] Field of Search ..... 428/15, 16, 542.2

[56] References Cited

U.S. PATENT DOCUMENTS

| | | | |
|---|---|---|---|
| 3,546,052 | 12/1970 | McNamara | 428/15 |
| 4,073,397 | 2/1978 | Snodgrass | 428/16 X |
| 4,650,701 | 3/1987 | Jackson | 428/16 |

*Primary Examiner*—Henry F. Epstein
*Attorney, Agent, or Firm*—Pitts & Brittian

[57] ABSTRACT

A garden ornament comprising a molded ceramic body member defining a cavity having a caudal opening. The body member has a base portion that engages the ground and the opening is proximate the base portion. A sack member having an opening is disposed within the cavity of the body member and contains a dense, granular aggregate, such as sand thereby providing a weighted base portion of the garden ornament. Additionally a stability enhancing member defining an elongated rod member having a first end defining a point for penetrating the ground and a second end received within said cavity thereby substantially preventing lateral movement of said garden ornament.

6 Claims, 3 Drawing Sheets

GARDEN ORNAMENT WITH WEIGHTED BASE AND STABILITY ENHANCER

TECHNICAL FIELD

This invention relates to the field of objet d'art often found decorating yards and gardens. More specifically, it relates to a molded garden ornament having a weighted base and a stability enhancer.

BACKGROUND ART

The art of decorating flower gardens and/or yard with garden ornaments, such as statuettes of small animals and the like, has long been popular. These statuettes are sometimes molded of ceramic or another lightweight material. While it is desirable for the statuettes to be lightweight and capable of being easily moved from one location to another, the statuettes should resist being blown over by wind or being unintentionally carried away. What is needed is a means of weighting the statuettes and securing them in place, while maintaining the convenience of readily repositioning the statuettes.

Accordingly, it is an object of this invention to provide a garden ornament with a weighted base.

It is another object to provide a garden ornament with a weighted base that further includes a ground piercing member to further secure the garden ornament in a selected location thereby enhancing the garden ornament's stability.

Other objects and advantages over the prior art will become apparent to those skilled in the art upon reading the detailed description together with the drawings as described as follows.

DISCLOSURE OF THE INVENTION

In accordance with the various features of this invention, a garden ornament having a weighted base and an additional means of securing the garden ornament in a selected location within a yard or garden is provided. Conventionally, molded garden ornaments are hollow. In accordance with the present invention, a sack member, containing a dense, granular aggregate, such as sand, is disposed within the hollow cavity of the molded garden ornament thereby providing additional mass to the garden ornament. An elongated rod member, having first and second ends, having its first end inserted into the ground and its second end inserted into the base provides additional stability. Thus, the present invention is useful for providing additional mass and stability to, otherwise, relatively lightweight garden ornaments.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A garden ornament having a weighted base and a stability enhancer, constructed in accordance with the present invention, is illustrated generally as 10 in the Figures. While garden ornament 10 is illustrated in the general shape of a rabbit those skilled in the art will appreciate that the garden ornament could be in the general shape of any small animal, cherub or the like.

Figure 1:
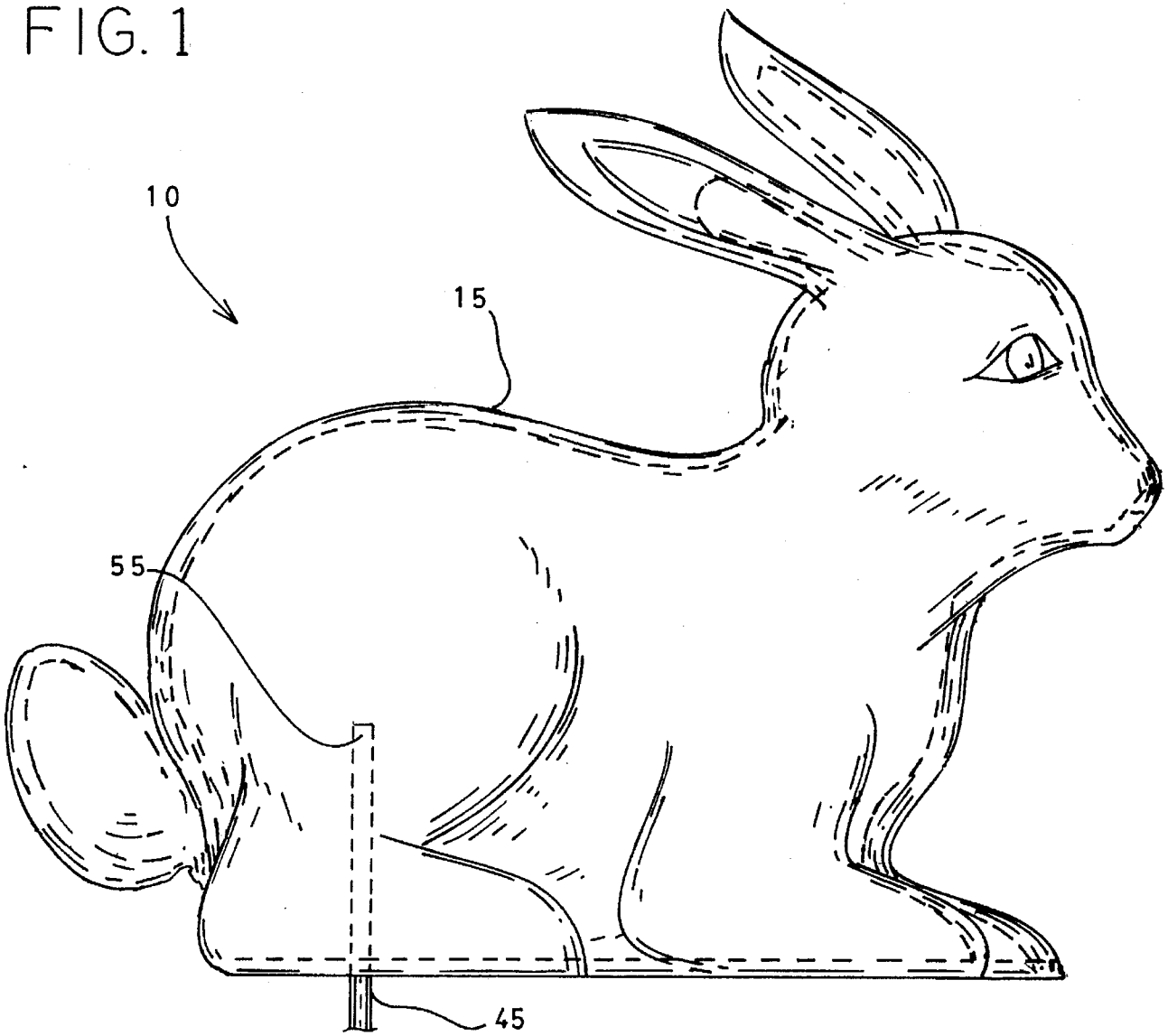
FIG. 1 illustrates a right side elevational view of the garden ornament of the present invention.
Figure 2:
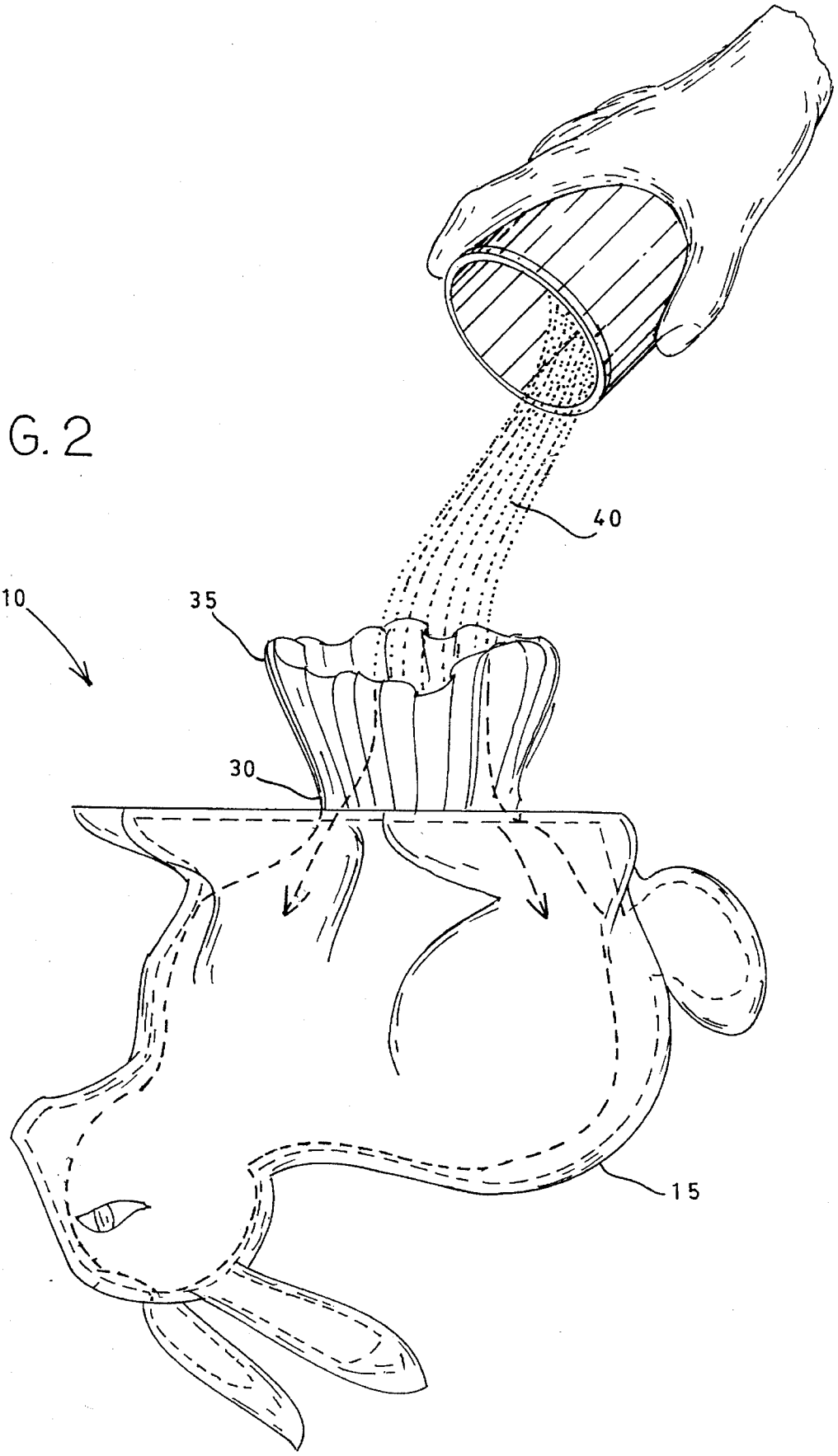
FIG. 2 illustrates a side elevational view of the garden ornament of the present invention being filled with an aggregate such as, but not limited to, sand.
Figure 3:
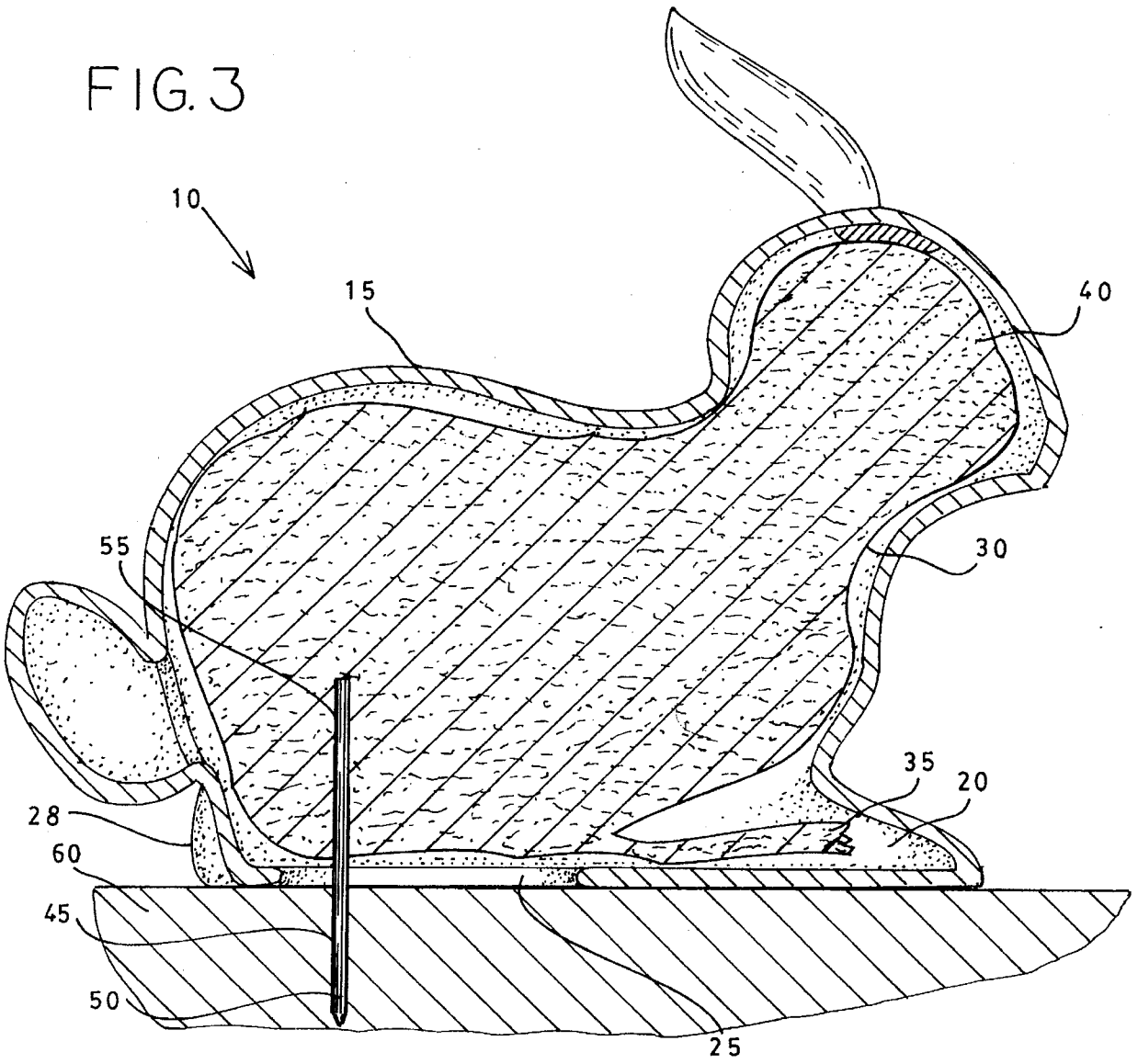
FIG. 3 illustrates a cross-sectional view of the garden ornament of the present invention.

Garden ornament 10 has a molded body member 15, which in the preferred embodiment is molded of ceramic. Those skilled in the art will recognize that conventionally molded garden ornaments have a hollow cavity 20 disposed within body member 15, hollow cavity 20 terminating in an opening 25. In the preferred embodiment, opening 25 defines a caudal opening proximate the base portion 28 of body member 15. A sack member 30, having an open end 35, is disposed within hollow cavity 20. Sack member 30 contains a dense, granular aggregate 40, such as, though not limited to, sand. Aggregate 40 can be poured into the open end 35 of sack member 30 as seen in FIG. 2. In the preferred embodiment, sack member 30 is substantially non-porous. However, those skilled in the art will recognize that the relative porosity of sack member 30 is determined by the granular size of aggregate 40, i.e. sack member 30 must be capable of containing aggregate 40.

In the preferred embodiment, a stability enhancer 45 is provided in order to prevent unintended lateral movement of garden ornament 10. In this regard, stability enhancer 45 defines an elongated rod member having a first end 50 that, preferably, is pointed, and a second end 55. First end 50 is inserted into the ground 60 such that substantially half of stability enhancer 45 penetrates ground 60. Garden ornament 10 is positioned such that opening 25 receives second end 55 thereby substantially preventing lateral movement and thus enhancing stability of the garden ornament.

From the foregoing description, it will be recognized by those skilled in the art that a garden ornament having a weighted base and a stability enhancer, offering advantages over the prior art has been provided. Specifically, the garden ornament having a weighted base and a stability enhancer provides a stable garden ornament having a stability enhancing ground piercing member to further secure the garden ornament in a selected location.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A garden ornament to be placed on a surface of ground, said garden ornament comprising:

a body member, said body member having a cavity having an opening, said body member having a base portion wherein said base portion engages said ground, said opening proximate said base portion;

a sack member having an opening disposed within said cavity;

a dense, granular aggregate carried within said sack member thereby providing a weighted base portion of said garden ornament; and a stability enhancing member defining an elongated rod member, said elongated rod member having a first end for penetrating said ground and a second end received within said cavity thereby substantially preventing lateral movement of said garden ornament.

2. The garden ornament of claim 1 wherein said dense granular aggregate is sand.

3. The garden ornament of claim 1 wherein said first end defines a point.

4. The garden ornament of claim 1 wherein said body member is molded of ceramic.

5. A garden ornament to be placed on a surface of ground, said garden ornament comprising:

a molded ceramic body member, said molded ceramic body member being of a size and configuration of a rabbit, said body member having a cavity including a caudal opening, said body member having a base portion, wherein said base portion engages said ground, said caudal opening being disposed proximate said base portion;

a substantially non-porous sack member having an opening disposed within said cavity;

a dense, granular aggregate carried within said sack member thereby providing a weighted base portion of said garden ornament; and a stability enhancing member defining an elongated rod member, said elongated rod member having a first end defining a point for penetrating said ground and a second end received within said cavity thereby substantially preventing lateral movement of said garden ornament.

6. The garden ornament of claim 5 wherein said dense granular aggregate is sand.

* * * * *